US008850858B2

(12) United States Patent
Nave

(10) Patent No.: US 8,850,858 B2
(45) Date of Patent: Oct. 7, 2014

(54) LOCK SUBASSEMBLY

(71) Applicant: Master Lock Company LLC, Oak Creek, WI (US)

(72) Inventor: Zachery T. Nave, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 13/795,670

(22) Filed: Mar. 12, 2013

(65) Prior Publication Data

US 2014/0157838 A1 Jun. 12, 2014

Related U.S. Application Data

(60) Provisional application No. 61/734,079, filed on Dec. 6, 2012.

(51) Int. Cl.

| | |
|---|---|
| ***E05B 47/00*** | (2006.01) |
| ***E05B 37/06*** | (2006.01) |
| ***E05B 67/02*** | (2006.01) |
| ***E05B 67/18*** | (2006.01) |

(52) U.S. Cl.

CPC ..... *E05B 67/18* (2013.01); *E05B 67/02* (2013.01)

USPC ..... 70/279.1; 70/21; 70/38 A; 70/278.1

(58) Field of Classification Search

None

See application file for complete search history.

(56) References Cited

U.S. PATENT DOCUMENTS

| | | | |
|---|---|---|---|
| 656,672 | A | 8/1900 | Spencer |
| 1,140,919 | A | 5/1915 | Shipman |
| 1,310,634 | A | 7/1919 | Rozycki |
| 1,331,933 | A | 2/1920 | Kodish |
| 1,463,230 | A | 7/1923 | Squires |
| 1,607,758 | A | 11/1926 | Junkunc |
| 1,703,193 | A | 2/1929 | Jacobi |
| 1,719,637 | A | 7/1929 | Werner |
| 1,743,331 | A | 1/1930 | Ellison |
| 2,116,965 | A | 5/1938 | Schoorel et al. |

(Continued)

FOREIGN PATENT DOCUMENTS

| | | |
|---|---|---|
| CN | 1482328 | 3/2004 |
| CN | 2625517 | 7/2004 |

(Continued)

OTHER PUBLICATIONS

International Search Report and Written Opinion from International Application No. PCT/US2013/073214 mailed Dec. 24, 2013.

*Primary Examiner* — Christopher Boswell

(74) *Attorney, Agent, or Firm* — Calfee, Halter & Griswold LLP

(57) ABSTRACT

A lock subassembly for a padlock includes a housing, a locking element, and a locking mechanism. The housing defines an internal cavity and at least one shackle bore isolated from the internal cavity. The locking element is disposed in a first portion of the internal cavity and extends beyond an upper surface of the housing. The locking element is movable between a locked position for interlocking engagement with a shackle and an unlocked position for releasing the shackle. The locking mechanism is disposed in a second portion of the internal cavity and is operable between a locking condition securing the locking element in the locked position and an unlocking condition permitting movement of the locking element to the unlocked position.

21 Claims, 13 Drawing Sheets

(56) References Cited

U.S. PATENT DOCUMENTS

| | | | |
|---|---|---|---|
| 2,132,201 | A | 10/1938 | Allman |
| 2,160,294 | A | 5/1939 | Soref |
| 2,673,457 | A | 3/1954 | Miller |
| 2,691,288 | A | 10/1954 | Childs |
| 2,775,112 | A | 12/1956 | Taylor |
| 2,780,087 | A | 2/1957 | Miller |
| 2,830,447 | A | 4/1958 | Miller |
| 2,852,928 | A | 9/1958 | Miller |
| 2,931,204 | A | 4/1960 | Check |
| 3,477,261 | A | 11/1969 | Siana |
| 3,720,083 | A | 3/1973 | Wellekens |
| 3,742,739 | A | 7/1973 | Hickman |
| 3,797,004 | A | 3/1974 | Muessel et al. |
| 3,831,065 | A | 8/1974 | Martin et al. |
| 3,835,675 | A | 9/1974 | Lippisch |
| 3,901,057 | A | 8/1975 | Coley, Sr. |
| 3,979,931 | A | 9/1976 | Man |
| 4,070,882 | A | 1/1978 | Ruiz |
| 4,220,022 | A | 9/1980 | Willach |
| 4,236,394 | A | 12/1980 | Harrington et al. |
| 4,476,698 | A | 10/1984 | Treslo |
| 4,556,872 | A | 12/1985 | Masoncup et al. |
| 4,581,652 | A | 4/1986 | Kinoshita et al. |
| 4,609,780 | A | 9/1986 | Clark |
| 4,655,368 | A | 4/1987 | Bateman et al. |
| 4,726,206 | A | 2/1988 | Hsu |
| 4,754,626 | A | 7/1988 | Siegel |
| 4,766,746 | A | 8/1988 | Henderson et al. |
| 4,802,210 | A | 1/1989 | Spencer et al. |
| 4,808,993 | A | 2/1989 | Clark |
| 4,829,795 | A | 5/1989 | Taylor |
| 4,838,052 | A | 6/1989 | Williams et al. |
| 4,851,652 | A | 7/1989 | Imran |
| 4,893,248 | A | 1/1990 | Pitts et al. |
| 4,896,370 | A | 1/1990 | Kasparian et al. |
| 4,929,880 | A | 5/1990 | Henderson et al. |
| 5,022,175 | A | 6/1991 | Oncke et al. |
| 5,033,282 | A | 7/1991 | Gartner et al. |
| 5,042,277 | A | 8/1991 | Jenn-Rong |
| 5,090,222 | A | 2/1992 | Imran |
| 5,156,028 | A | 10/1992 | Jiang |
| 5,181,403 | A | 1/1993 | Lii |
| 5,184,491 | A | 2/1993 | Schittenhelm |
| 5,195,342 | A | 3/1993 | Werner |
| 5,270,681 | A | 12/1993 | Jack |
| 5,280,518 | A | 1/1994 | Danler et al. |
| 5,345,794 | A | 9/1994 | Jenks |
| 5,372,019 | A | 12/1994 | Hsiao |
| 5,392,552 | A | 2/1995 | McCarthy et al. |
| 5,404,735 | A | 4/1995 | Hsieh |
| 5,417,000 | A | 5/1995 | Chen |
| 5,419,068 | A | 5/1995 | Pages et al. |
| 5,475,996 | A | 12/1995 | Chen |
| 5,488,338 | A | 1/1996 | Seymour et al. |
| 5,495,093 | A | 2/1996 | Griffith |
| 5,506,393 | A | 4/1996 | Ziarno |
| 5,507,161 | A | 4/1996 | Broekaert et al. |
| 5,522,243 | A | 6/1996 | Kusmiss |
| 5,550,529 | A | 8/1996 | Burge |
| 5,552,777 | A | 9/1996 | Gokcebay et al. |
| 5,561,935 | A | 10/1996 | McCarthy et al. |
| 5,561,996 | A | 10/1996 | Chang |
| 5,573,412 | A | 11/1996 | Anthony |
| 5,585,866 | A | 12/1996 | Miller et al. |
| 5,587,702 | A | 12/1996 | Chadfield |
| 5,589,058 | A | 12/1996 | Bauer |
| 5,589,892 | A | 12/1996 | Knee et al. |
| 5,590,191 | A | 12/1996 | Guevara |
| 5,598,725 | A | 2/1997 | Chang |
| 5,601,440 | A | 2/1997 | Richter |
| 5,605,066 | A | 2/1997 | Hurskainen |
| 5,612,668 | A | 3/1997 | Scott |
| 5,621,996 | A | 4/1997 | Mowl, Jr. |
| 5,629,733 | A | 5/1997 | Youman et al. |
| 5,727,405 | A | 3/1998 | Cromwell |
| 5,791,172 | A | 8/1998 | Deighton et al. |
| 5,798,701 | A | 8/1998 | Bernal et al. |
| 5,815,557 | A | 9/1998 | Larson |
| 5,821,866 | A | 10/1998 | Bernal et al. |
| 5,831,537 | A | 11/1998 | Marman |
| D402,636 | S | 12/1998 | Taft |
| 5,844,458 | A | 12/1998 | Bartholomew et al. |
| 5,868,013 | A | 2/1999 | Julien |
| D411,949 | S | 7/1999 | Hill |
| 5,927,112 | A | 7/1999 | Yamashita |
| 5,936,553 | A | 8/1999 | Kabel |
| 5,953,940 | A | 9/1999 | Ling |
| 6,011,469 | A | 1/2000 | Taft et al. |
| 6,046,558 | A | 4/2000 | Larson et al. |
| 6,047,575 | A | 4/2000 | Larson et al. |
| 6,064,430 | A | 5/2000 | Lefkowitz |
| D426,250 | S | 6/2000 | Lefkowitz |
| 6,072,402 | A | 6/2000 | Kniffin et al. |
| 6,079,241 | A | 6/2000 | Burleigh et al. |
| D427,884 | S | 7/2000 | Castellanos et al. |
| 6,249,310 | B1 | 6/2001 | Lefkowitz |
| 6,396,438 | B1 | 5/2002 | Seal |
| 6,401,501 | B1 | 6/2002 | Kajuch et al. |
| 6,425,274 | B1 | 7/2002 | Laitala et al. |
| 6,442,983 | B1 | 9/2002 | Thomas et al. |
| 6,517,127 | B1 | 2/2003 | Lu et al. |
| D471,429 | S | 3/2003 | Williams et al. |
| 6,585,302 | B2 | 7/2003 | Lin |
| 6,591,643 | B1 | 7/2003 | Cannella et al. |
| 6,598,439 | B1 | 7/2003 | Chen |
| 6,598,909 | B2 | 7/2003 | Lu |
| 6,718,803 | B2 | 4/2004 | Knoll |
| 6,761,051 | B1 | 7/2004 | Tsai |
| 6,792,779 | B1 | 9/2004 | Shen |
| 6,807,834 | B2 | 10/2004 | Tsai |
| 6,832,500 | B1 | 12/2004 | Chen |
| 6,898,952 | B1 | 5/2005 | Lin |
| 6,993,943 | B1 | 2/2006 | Chang |
| 7,117,698 | B2 | 10/2006 | Lai |
| 7,251,965 | B2 | 8/2007 | Yu |
| 7,316,141 | B2 | 1/2008 | Goldman |
| D567,628 | S | 4/2008 | Rohde et al. |
| D594,311 | S | 6/2009 | Stevens |
| D594,731 | S | 6/2009 | Plato |
| 7,562,545 | B2 | 7/2009 | Lai et al. |
| 7,571,627 | B2 | 8/2009 | Yu |
| D605,494 | S | 12/2009 | Plato |
| D629,280 | S | 12/2010 | Plato |
| D637,062 | S | 5/2011 | Plato |
| 7,934,405 | B2 | 5/2011 | Burmesch et al. |
| 7,948,359 | B2 * | 5/2011 | Marcelle et al. ..... 70/38 A |
| 8,453,481 | B2 * | 6/2013 | Meekma ..... 70/38 A |
| 8,640,514 | B2 * | 2/2014 | Goren et al. ..... 70/280 |
| 2002/0046584 | A1 | 4/2002 | Lumpkin et al. |
| 2003/0121295 | A1 * | 7/2003 | Lavikainen et al. ..... 70/38 A |
| 2003/0196461 | A1 | 10/2003 | Liou |
| 2004/0093914 | A1 | 5/2004 | Vito |
| 2004/0194516 | A1 * | 10/2004 | Chen ..... 70/38 A |
| 2005/0156441 | A1 | 7/2005 | Tsai |
| 2006/0283216 | A1 | 12/2006 | Marcelle et al. |
| 2007/0220929 | A1 | 9/2007 | Green |
| 2008/0173049 | A1 | 7/2008 | Burmesch et al. |
| 2008/0314093 | A1 | 12/2008 | Nave |
| 2009/0113947 | A1 | 5/2009 | Lai et al. |
| 2009/0145178 | A1 | 6/2009 | Nave et al. |
| 2009/0282876 | A1 | 11/2009 | Zuraski et al. |
| 2009/0320537 | A1 | 12/2009 | Alexander |
| 2010/0083713 | A1 | 4/2010 | Woodling |
| 2010/0095718 | A1 | 4/2010 | Lai et al. |
| 2012/0011902 | A1 * | 1/2012 | Meekma ..... 70/25 |

FOREIGN PATENT DOCUMENTS

| | | |
|---|---|---|
| CN | 2675799 | 2/2005 |
| CN | 2675802 | 2/2005 |
| CN | 2680791 | 2/2005 |
| DE | 202004002706 | 5/2004 |
| DE | 202004003813 | 5/2004 |
| DE | 100 56 119 B4 | 12/2005 |

(56) References Cited

FOREIGN PATENT DOCUMENTS

| | | |
|---|---|---|
| GB | 1531951 | 11/1978 |
| GB | 2122283 | 1/1984 |
| GB | 2229220 | 9/1990 |
| TW | 0220911 | 8/1991 |
| TW | 0220910 | 3/1992 |
| TW | 022482 | 9/1992 |
| TW | 0220912 | 4/1994 |
| TW | 553286 | 9/2003 |
| WO | 89/11577 | 11/1989 |
| WO | 90/15910 | 12/1990 |

* cited by examiner

LOCK SUBASSEMBLY

CROSS-REFERENCE TO RELATED APPLICATION

This application claims priority to and the benefit of U.S. Provisional Patent Application Ser. No. 61/734,079, entitled "LOCK SUBASSEMBLY" and filed Dec. 6, 2012, the entire disclosure of which is incorporated herein by reference.

BACKGROUND

Security devices, such as padlocks and other types of conventional locks, are used, for example, to prevent access to a room, building, enclosure, container, or piece of equipment. Exemplary padlocks include those opened by a key and those opened by manipulation of lock components in accordance with an authorized combination. In a conventional padlock, a shackle is secured within a lock body by one or more internal locking members that are received in corresponding notches in the shackle to prevent axial withdrawal of the shackle from the lock body.

SUMMARY

According to an exemplary embodiment of the present application, a lock subassembly for a padlock includes a housing, a locking element, and a locking mechanism. The housing defines an internal cavity and at least one shackle bore isolated from the internal cavity. The locking element is disposed in a first portion of the internal cavity and extends beyond an upper surface of the housing. The locking element is movable between a locked position for interlocking engagement with a shackle and an unlocked position for releasing the shackle. The locking mechanism is disposed in a second portion of the internal cavity and is operable between a locking condition securing the locking element in the locked position and an unlocking condition permitting movement of the locking element to the unlocked position.

According to another exemplary embodiment of the present application, a padlock includes a lock body, a shackle, a locking member, and a lock subassembly. The shackle includes long and short legs receivable in corresponding first and second shackle openings in the lock body. The shackle is moveable in an axial direction between a closed position and an open position, with the short leg being withdrawn from the lock body in the open position. The locking member is disposed in the lock body and is engageable with the shackle to secure the shackle in the closed position. The lock subassembly includes a housing defining an internal cavity, a blocker disposed in a first portion of the internal cavity, and a locking mechanism disposed in a second portion of the internal cavity. The blocker extends beyond an upper surface of the housing and is movable between a locked position securing the locking member in interlocking engagement with the shackle and an unlocked position permitting disengagement of the locking member from the shackle. The locking mechanism is operable between a locking condition securing the blocker in the locked position and an unlocking condition permitting movement of the blocker to the unlocked position. The internal cavity is sealed against ingress of contaminants entering the lock body through the first and second shackle openings.

According to another exemplary embodiment of the present application, a method of assembling a padlock is described. In the exemplary method, a lock body is provided with an upper wall defining first and second shackle openings, a lower wall, and a side wall extending between the upper wall and the lower wall and defining a side opening in the lock body. A lock subassembly is provided with a housing defining an internal cavity and a shackle bore isolated from the internal cavity, a blocker extending from the internal cavity beyond an upper surface of the housing, and a locking mechanism disposed in the internal cavity. The lock subassembly is inserted into the lock body through the side opening, such that the shackle bore aligns with the first shackle opening. A shackle leg of a shackle is installed through the first shackle opening and through the shackle bore. A locking member is inserted vertically between the upper surface of the lock subassembly housing and the upper wall of the lock body, and laterally between the blocker and the shackle.

BRIEF DESCRIPTION OF THE DRAWINGS

Further features and advantages of the invention will become apparent from the following detailed description made with reference to the accompanying drawings, wherein.

DETAILED DESCRIPTION

Figure 1C:
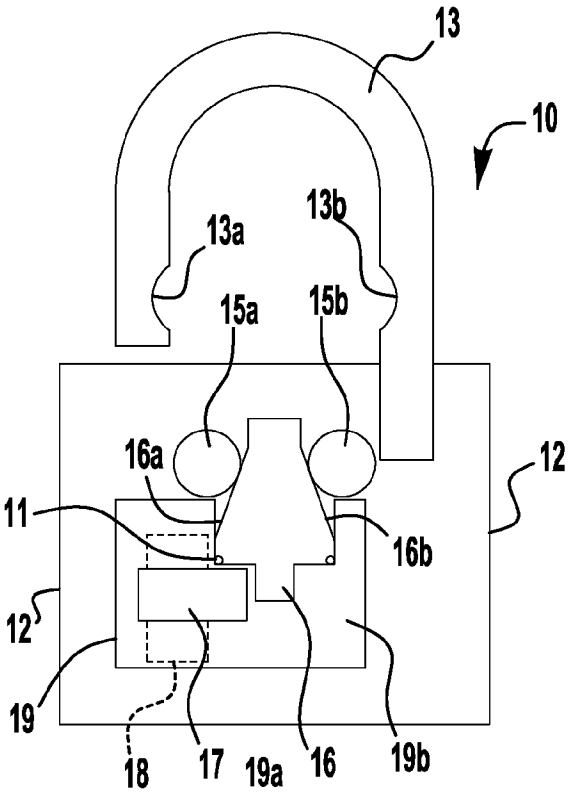
FIG. 1C is a front cross-sectional schematic view of the padlock of FIG. 1A shown in an unlocked, opened shackle condition.

This Detailed Description merely describes exemplary embodiments and is not intended to limit the scope of the claims in any way. Indeed, the invention as claimed is broader than and unlimited by the exemplary embodiments, and the terms used in the claims have their full ordinary meaning.

Also, while the exemplary embodiments described in the specification and illustrated in the drawings relate to an electronic keypad pushbutton padlock, it should be understood that many of the inventive features described herein may be applied to other types of electronic padlocks, including, for example, remote operated (e.g., infrared, RFID, BLUETOOTH®, or other wireless communications) or biometric (e.g., fingerprint scan, voice recognition) padlocks, as well as other types of locking devices, including, for example, safes, lock boxes, cable locks, and locking bolts. Still other inventive features described herein may apply to purely mechanical locking mechanisms, including, for example, key operated or combination dial padlocks.

Further, while the padlocks shown and described herein include conventional rigid U-shaped shackles with long and short shackle legs that are circular in cross-section, other padlock shackles may additionally or alternatively be used. For example, shackles may vary in shape, size, cross-section, locking engagement (e.g., features other than notches), material, and flexibility (including cable-type shackles).

The present application contemplates, in part, a modular lock subassembly for a lock (e.g., a padlock) that provides a movable locking element (e.g., a sliding blocker), for example, for secure locking of a padlock shackle with a lock body. This arrangement may, for example, permit preassembly of a number of modular lock subassemblies for incorporation into a variety of locks, thereby facilitating assembly and/or customization of the locks. Additionally or alternatively, the modular lock subassembly may be configured to impede or prevent ingress of moisture or other contaminants into the internal locking components of the modular lock subassembly, as may be introduced through openings in the lock body (e.g., shackle holes, keyway, etc.). In one such example, an internal lock cavity of the modular lock subassembly may be isolated from the shackle bores of the lock body, such that moisture or other contaminants entering the lock body through the shackle holes do not reach the module cavity.

Figure 1B:
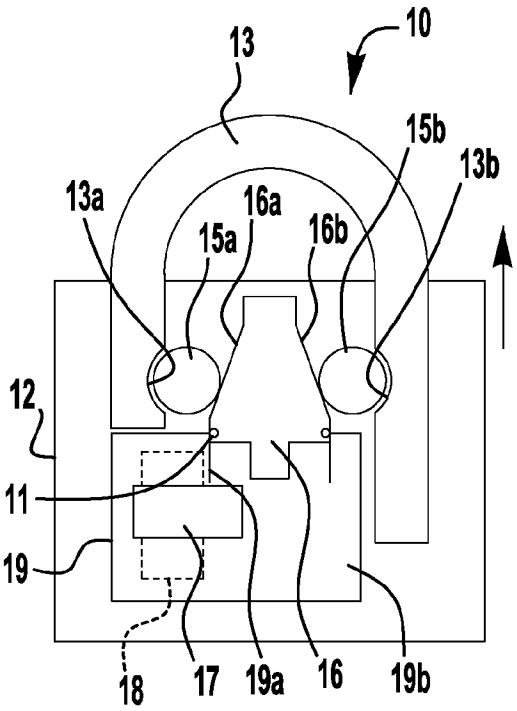
FIG. 1B is a front cross-sectional schematic view of the padlock of FIG. 1A, shown in an unlocked, closed shackle condition.
Figure 1A:
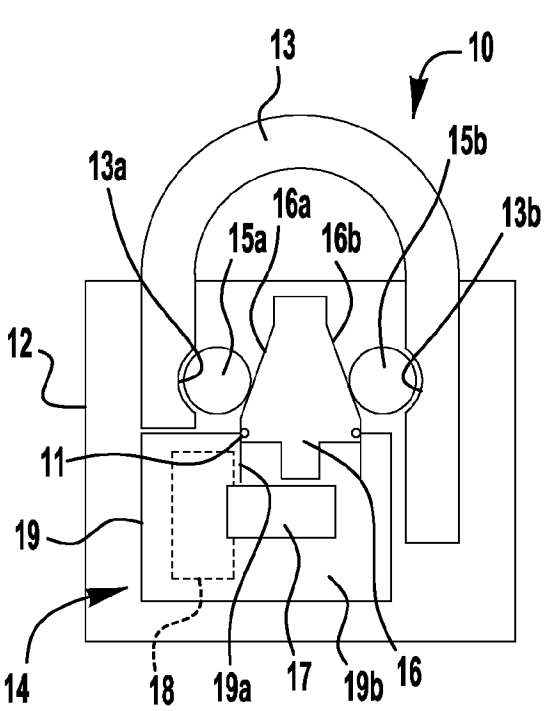
FIG. 1A is a front cross-sectional schematic view of an exemplary padlock shown in a locked condition.

In one such exemplary padlock 10, as schematically shown in FIGS. 1A, 1B, and 1C, a lock subassembly module 14 is disposed within a lock body 12 and includes a blocker 16 disposed within and extending from a blocker bore or upper portion 19*a* of a lock cavity in a module housing 19 to force locking members 15*a*, 15*b* into locking engagement with notches 13*a*, 13*b* in the padlock shackle 13. In the locked condition, shown in FIG. 1A, a latch member 17 within an lower portion 19*b* of the lock cavity of the module housing 19 secures the blocker 16 in a shackle retaining or locked position that prevents disengagement of the locking members 15*a*, 15*b* from the shackle notches 13*a*, 13*b*. In the unlocked condition, shown in FIG. 1B, the latch member 17 is moved or is made movable by a driver 18 within the lock cavity 19*b* to permit movement of the blocker 16 to a shackle releasing or unlocked position (shown in FIG. 1C) and disengagement of the locking members 15*a*, 15*b* from the shackle notches 13*a*, 13*b* for withdrawal of the shackle 13 from the lock body 12.

As shown, a seal 11 may be provided between the sliding blocker 16 and an inner surface of the upper cavity portion 19*a*, such that moisture or other contaminants that enter the lock body 12 through shackle bores 12*a* in the lock body 12 are prevented from entering the lower cavity portion 19*b*. The lock subassembly module 14 may include additional seals (e.g., in an electrical wiring port in the module housing or between assembled body portions of the module housing, not shown) to further seal against the ingress of moisture and other contaminants into the module cavity.

While the schematic embodiment of FIGS. 1A, 1B, and 1C shows a vertical sliding blocker 16 that is retracted into the module housing 19 to permit disengagement of the locking members 15*a*, 15*b* from the shackle notches 13*a*, 13*b*, other types of blocker movement may be employed, including vertical sliding extension of the blocker when unlocking, as well as pivoting, rotating, ratcheting, and/or horizontal or other sliding movement of the blocker (not shown). Many different types of latch members may be utilized to obstruct movement of the blocker, including, for example, sliding, pivoting, and/or rotating latch components. In one embodiment, a latch member includes a rotatable cam having a cutout portion that aligns with the blocker end portion to permit movement of the blocker to the shackle releasing position.

Many different types of drivers may be utilized to move (or make movable) a blocker in a padlock, including, for example, key-operated mechanical drivers (e.g., key cylinders), combination dial operated mechanical drivers (e.g., a wheel or cam), or electromechanical drivers (e.g., motors, solenoids, or other such actuators). In one embodiment, an electromechanical driver includes a rotary motor configured to move a latch member to provide clearance for movement of a blocker to a shackle releasing position. While the latch member may be directly rotatable by the motor, such that the latch member rotates about the motor axis, in other embodiments, a driver may include a motor (or other mechanical device) and a linking member (e.g., a cam or gear), with the motor being be connected to the latch member by the linking member. Such an arrangement may provide deadlocking engagement between the driver and the latch member to prevent unauthorized forced movement of the latch member. For example, the linking member may provide for rotation of the latch member about an axis spaced apart from and/or non-parallel with the driver axis, or altered, non-rotational movement of the latch member, such as, for example, sliding or pivoting movement of the latch member. The invention is operable and may be used with any suitable type of driver.

An electromechanical driver may be operated by one or more of a variety of interfaces, including, for example, electronic keys and/or key cards, electronic keypads, remote signal receiving transceivers, and biometric readers (e.g., fingerprint scanner). In one embodiment, an electronic keypad is configured to generate an actuation signal for transmission to an electromechanical driver in response to pressing of one or more buttons of the keypad in a predetermined sequence.

Figure 2:
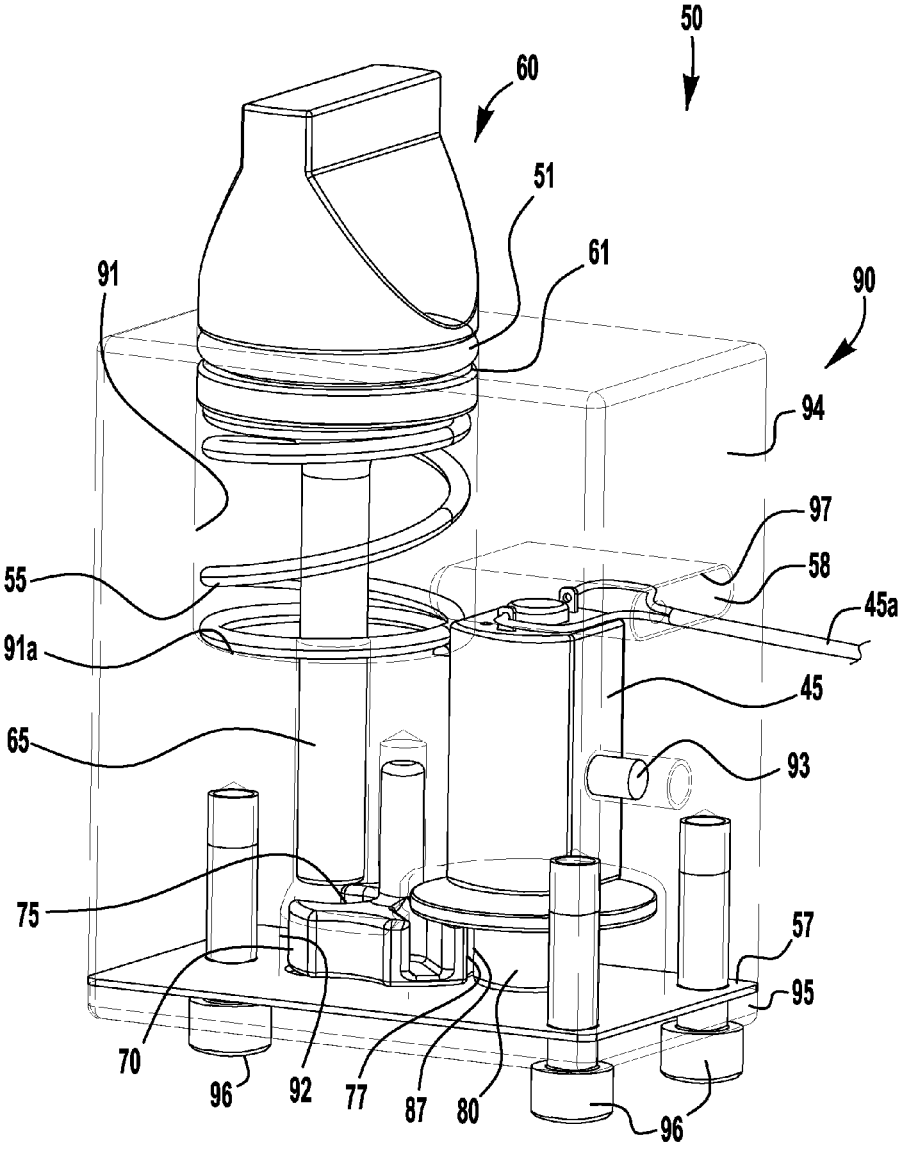
FIG. 2 is a perspective view of an exemplary lock subassembly module, with the module housing shown in phantom to illustrate additional features of the module.
Figure 3:
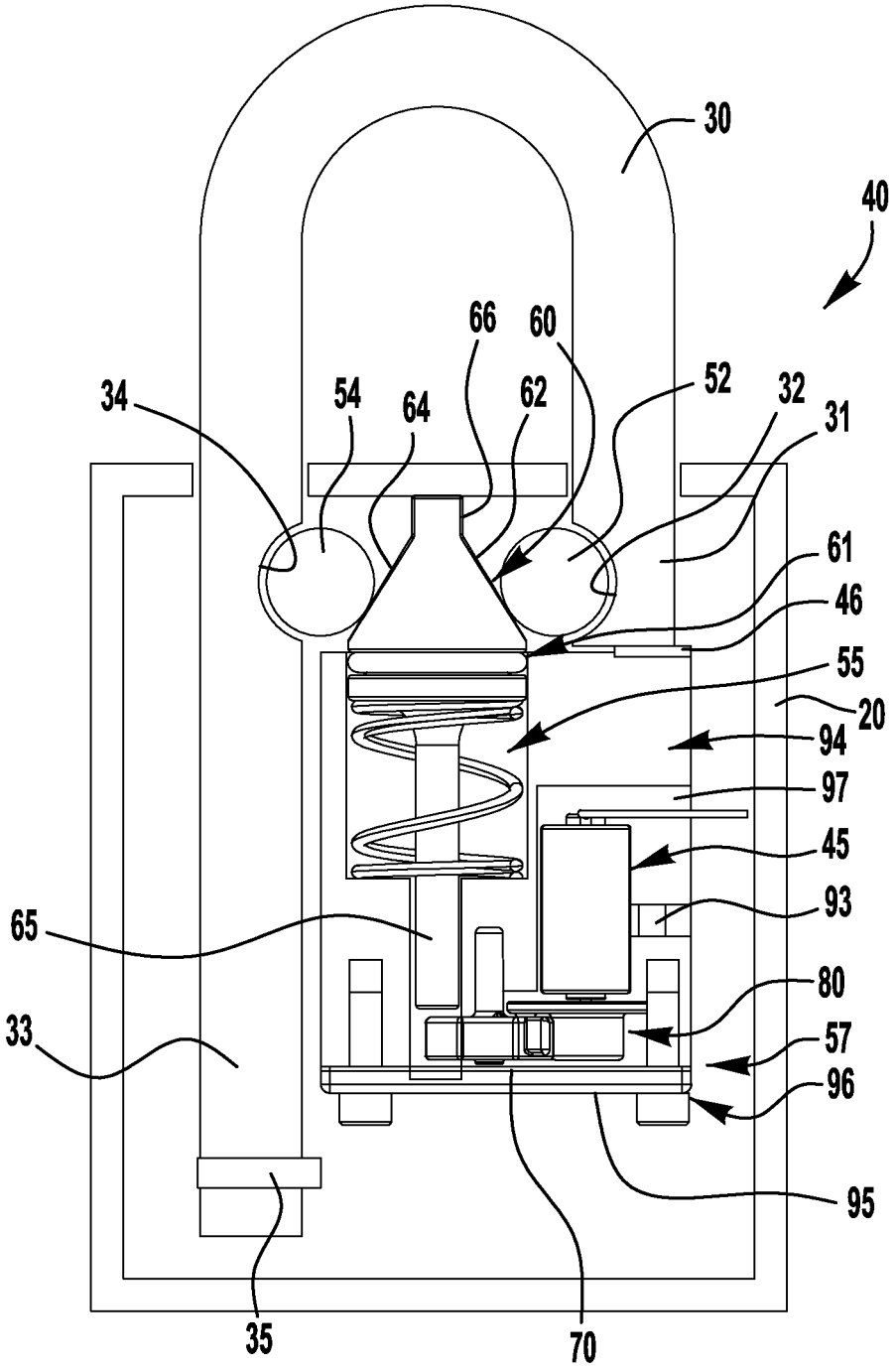
FIG. 3 is a front elevational view of the lock subassembly module of FIG. 2, shown assembled in a schematically illustrated padlock, with the module housing shown in phantom to illustrate additional features of the module.

FIGS. 2 and 3 illustrate an exemplary electromechanical modular lock subassembly 50 for assembly with a padlock 40 (shown schematically in FIG. 3). The lock subassembly 50 includes a module housing 90 and a blocker 60 partially disposed within and extending from an upper portion 91 (e.g., a vertical or axial bore) of a lock cavity in the housing 90. The blocker 60 includes an extension or post 65 that is adjacent to and abuts against a portion of a latch cam 70 (or other such latch member) disposed in a lower portion 92 of the housing lock cavity when the lock subassembly 50 is in a locked condition, thereby preventing axial movement of the blocker 60. A driver cam 80 and driving motor 45 are disposed in the lower portion 92 of the housing cavity. The motor 45 is operable, upon receipt of a electrical authorization signal through electrical wiring 45*a* (extending through a side port 97 in the housing 90), to rotate the driver cam 80 for rotation of the exemplary latch cam 70 to an unlocked condition, such that a gap or cutout 75 in the latch cam 70 aligns with the post 65 (moving the abutting portion of the latch cam out of alignment with the post) to permit axial movement of the blocker 60. A similar locking mechanism is described in co-pending U.S. Application Publication No. 2012/0011902, entitled PADLOCK (the "'902 Application"), the entire disclosure of which is incorporated herein by reference, to the extent that it does not conflict with the present application. A lock interface (e.g., one or more of a keypad, card reader, RFID transceiver, biometric sensor, etc.), may be electrically connected with the motor to deliver an authorization signal in response to an authorized user input (e.g., access code entry, key card swipe, remote signal transmission, fingerprint/retina scan, etc.).

While any suitable motor or other such actuator may be used, in one embodiment, a standard pulse width modulated DC motor having a nominal voltage of 3 V and a torque rating of 2 m-Nm/A is used (e.g., PMDC motor model no. NFC03MG-012 from Johnson Motor). The exemplary motor 45 is secured within the module housing 90 by a set screw 93 threaded with the module housing and tightened against the motor 45.

The exemplary module housing includes a housing body 94 in which the upper cavity portion 91 and lower cavity portion 92 are defined, and an end plate 95 secured to the housing body 94 (e.g., by fasteners 96) to retain the latch cam 70 and driver 80 within the module housing 90. The blocker 60 is spring biased (e.g., by spring 55 compressed between the blocker 60 and a shoulder 91*a* in the upper cavity portion 91) towards an extended or shackle retaining or locked position, and may, but need not, be retained with the module housing 90 by a retaining clip or other such structure (not shown).

According to an aspect of the present application, a modular lock subassembly may be provided with one or more external seals to prevent the ingress of moisture and other contaminants into the module housing, thereby protecting the inter subassembly components (particularly electronic and electromechanical components, such as a motor or switch) from damage. When a modular lock subassembly is utilized with a padlock, moisture and other contaminants that enter the lock body through the shackle holes are prevented from entering the module housing.

Many different types of external seals may be used. As one example, a body seal may be provided between a module housing body and end plate. In the illustrated embodiment, a gasket seal 57 is compressed between the housing body 94 and the end plate 95 to seal against ingress of contaminants between these components. As another example, an electrical port seal may be provided around electrical wiring extending from a module. In the illustrated embodiment, a plug seal 58 is installed in the side port 97 of the housing 90 to provide a seal around the electrical wiring 45*a*. As still another example, a dynamic seal may be provided between a vertical sliding blocker and an internal housing cavity. In the illustrated example, the blocker 60 includes a circumferential groove 61 that retains an annular seal 51 (e.g., a gasket or O-ring) sized to provide a sliding seal with the upper cavity portion 91.

In the illustrated embodiment, an exemplary rotatable driver cam 80 includes a contoured outer surface 87 that mates with a corresponding contoured surface 77 of the latch cam 70 to prevent rotational movement of the latch cam when the locking mechanism 50 is in a locked condition. While any suitable mating contoured surfaces may be utilized, in the illustrated embodiment, a cylindrical surface 87 of the driver cam 80 mates with a corresponding scalloped surface 77 of the latch cam 70 to prevent rotation of the latch cam while allowing rotation of the driver cam 80. An exemplary embodiment uses a "Geneva Cam" type arrangement, as described in greater detail in the above incorporated '902 Application. In an exemplary embodiment, during the unlocking operation, the driver cam 80 is rotated approximately 250° from the first latch cam deadlocking condition to the latch cam engaging condition, approximately 110° from the latch cam engaging condition to the latch cam unlocked condition (for 90° rotation of the latch cam from the locked condition to the unlocked condition), and approximately 250° from the latch cam unlocked condition to the second latch cam deadlocking condition, for a total of approximately 610° of rotation for the driver cam 80. By requiring extensive rotation (e.g., at least 270°, or at least 360°) of the driver cam 80 to rotate the latch cam 70 to the unlocked condition, unauthorized manipulation of the driver cam 80 (e.g., by lock-picking tools or other instruments) to an unlocking condition is effectively impeded. Other rotational ranges may additionally or alternatively be used to impede unauthorized manipulation of the locking mechanism.

When the post 65 is received in the cutout 75 during withdrawal of the shackle 30 (as described in greater detail above), interlocking engagement of the cutout 75 with the post 65 prevents return rotation of the latch cam 70 to the locked condition. When the shackle 30 is re-inserted into the lock body 20 and the shackle notches 32, 34 are aligned with the locking members 52, 54, the axial forces of the spring 55 on the blocker 60 forces the locking members 52, 54 laterally outward into the notches 32, 34, allowing the blocker 60 to be forced upward to the locked condition (i.e., holding the locking members in engagement with the shackle notches).

Once the blocker 60 has returned to the locked condition, separation of the post 65 from the cutout 75 allows for rotation of the latch cam 70 back to the locked condition. Many mechanisms may be used to rotate the latch cam 70 back to the locked condition, including, for example, a torsion return spring, key cylinder, combination dial mechanism, or motor. In the illustrated embodiment, the motor 45 is bi-directional, such that the motor provides a reverse rotational output to rotate the driver cam 80, and in turn, the latch cam 70, back to the locked conditions.

In the illustrated embodiment, a switch 46 may be provided under the short shackle leg 31. A standard detect switch may be used, such as, for example, a 2N detector switch type ESE22 from Panasonic. When the shackle 30 is re-engaged with or re-inserted into the lock body 20, the short shackle leg 31 actuates the switch 46 to prompt the motor 45 (through circuitry, not shown) to operate in the reverse or locking direction. The reverse operation of the motor 45 rotates the driver cam 80 in a reverse direction to return the latch cam 70 to a deadlocking condition. The switch 46 may also serve additional functions. For example, completion of an entered authorization code (for example, by pressing a series of buttons on an electronic keypad connected with the motor 45 by a PC board, as described in the above incorporated '902

Application) may be communicated by depressing the locked shackle 30 to engage the switch 46. This operation may also serve to remove any inadvertent load on the latch cam 70 by the blocker post 65 to facilitate reduced resistance in the motor-driven rotation of the driver cam 80 and latch cam 70. As shown, the shackle notches 32, 34 may be elongated to permit this vertical movement of the shackle 30.

In this unlocked condition, when the shackle 30 is axially pulled in an opening or withdrawing direction, a laterally inward force is directed from the shackle notches 32, 34 through the locking members 52, 54 to tapered camming surfaces 62, 64 of the blocker 60. These laterally inward forces against the tapered camming surfaces 62, 64 move the blocker 60 axially downward against spring 55, such that the post 65 is received in the cutout 75. In this axially downward position, laterally inward forces on the locking members 52, 54 (from pulling on the shackle 30) push the locking members laterally inward against a necked down portion 66 of the blocker 60, and out of engagement with the shackle notches 32, 34, thereby allowing the shackle 30 to be withdrawn to a disengaged or open position. The long shackle leg 33 may be provided with a retaining clip 35 or other structure to prevent complete withdrawal of the shackle 30 from the lock body 20.

Many other suitable mechanisms may additionally or alternatively be utilized to rotate the driver, including, for example, other types of electric or motor driven actuators, electrically operable solenoids, pneumatic actuators, and manually rotatable key cylinders or combination dials.

FIGS. 4-12 illustrate an exemplary padlock 140 with a electromechanical modular lock subassembly 150 assembled within the lock body 120. The lock subassembly 150 includes a module housing 190 and a blocker 160 partially disposed within and extending from an upper portion 191 of a housing cavity (e.g., a vertical or axial blocker bore) in an upper end of the housing 190. The blocker 160 includes an extension or post 165 that abuts against a latch cam 170 (or other such latch member) disposed in a lower portion 192 of the housing cavity when the lock subassembly 150 is in a locked condition, thereby preventing axial movement of the blocker 160. A driver cam 180 and driving motor 145 are disposed in the lower cavity portion 192 of the housing 190. Similar to the locking mechanism of the embodiment of FIGS. 2 and 3, and the locking mechanisms described in the above incorporated '902 Application, the motor 145 is operable, upon receipt of a electrical authorization signal through electrical wiring (not shown), to rotate the driver cam 180 for rotation of the exemplary latch cam 170 to an unlocked condition, such that a gap or cutout 175 in the latch cam 170 aligns with the post 165 to permit axial movement of the blocker 160.

Figure 4:
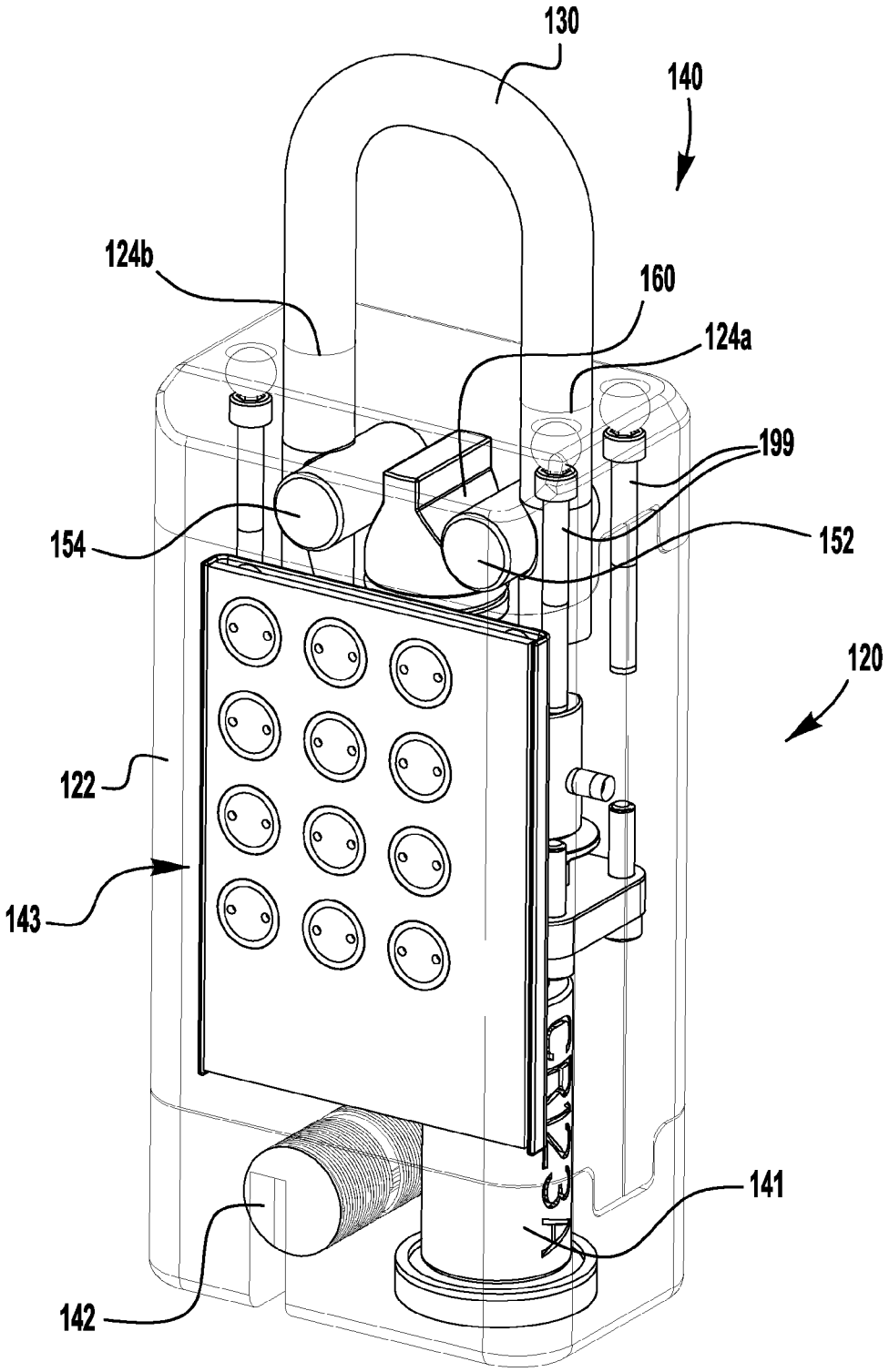
FIG. 4 is a front perspective view of an exemplary padlock shown in a locked condition, with the lock body shown in phantom to illustrate additional features of the padlock.
Figure 5:
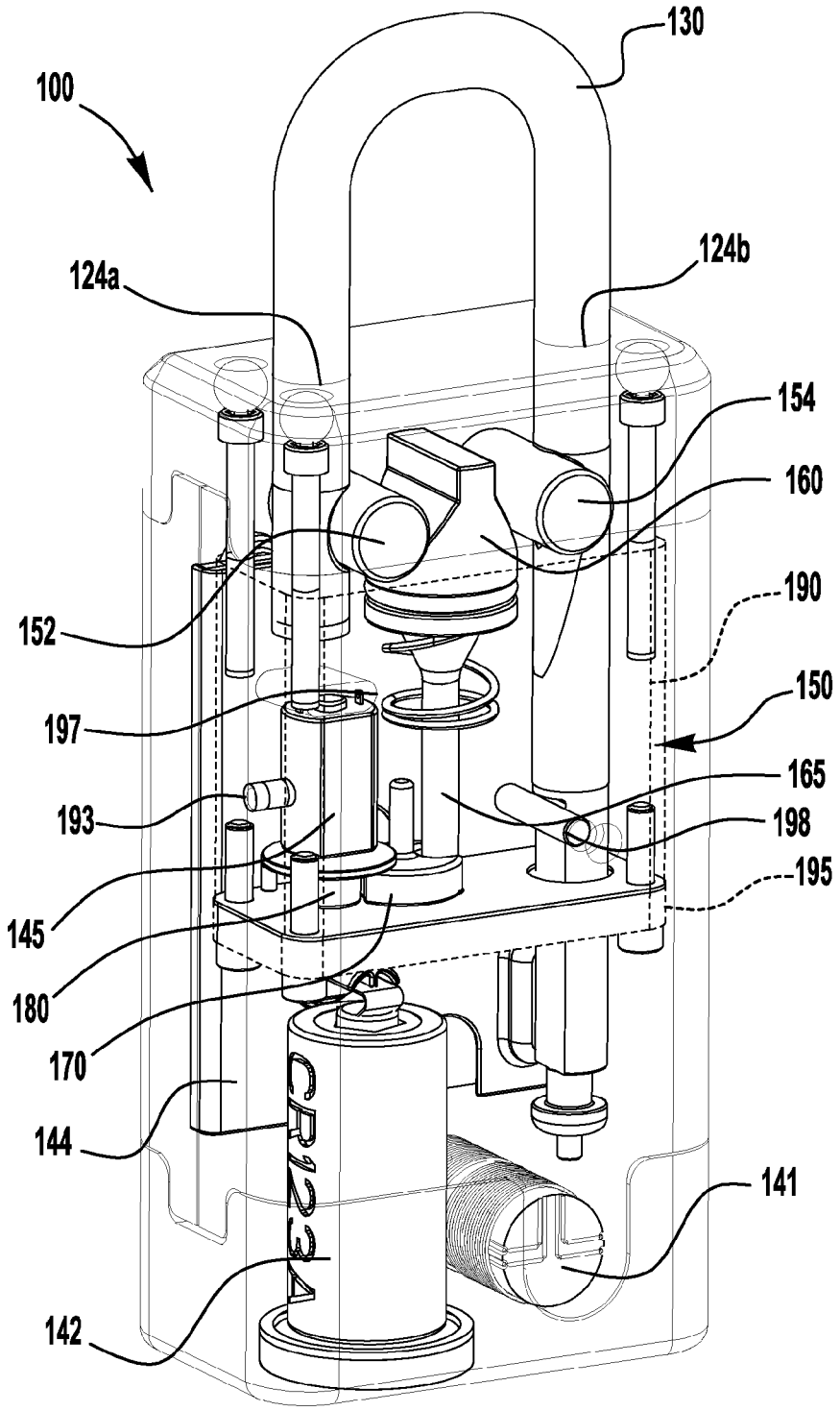
FIG. 5 is a rear perspective view of the padlock of FIG. 4 shown in a locked condition, with the lock body and lock subassembly module housing shown in phantom to illustrate additional features of the padlock.
Figure 6:
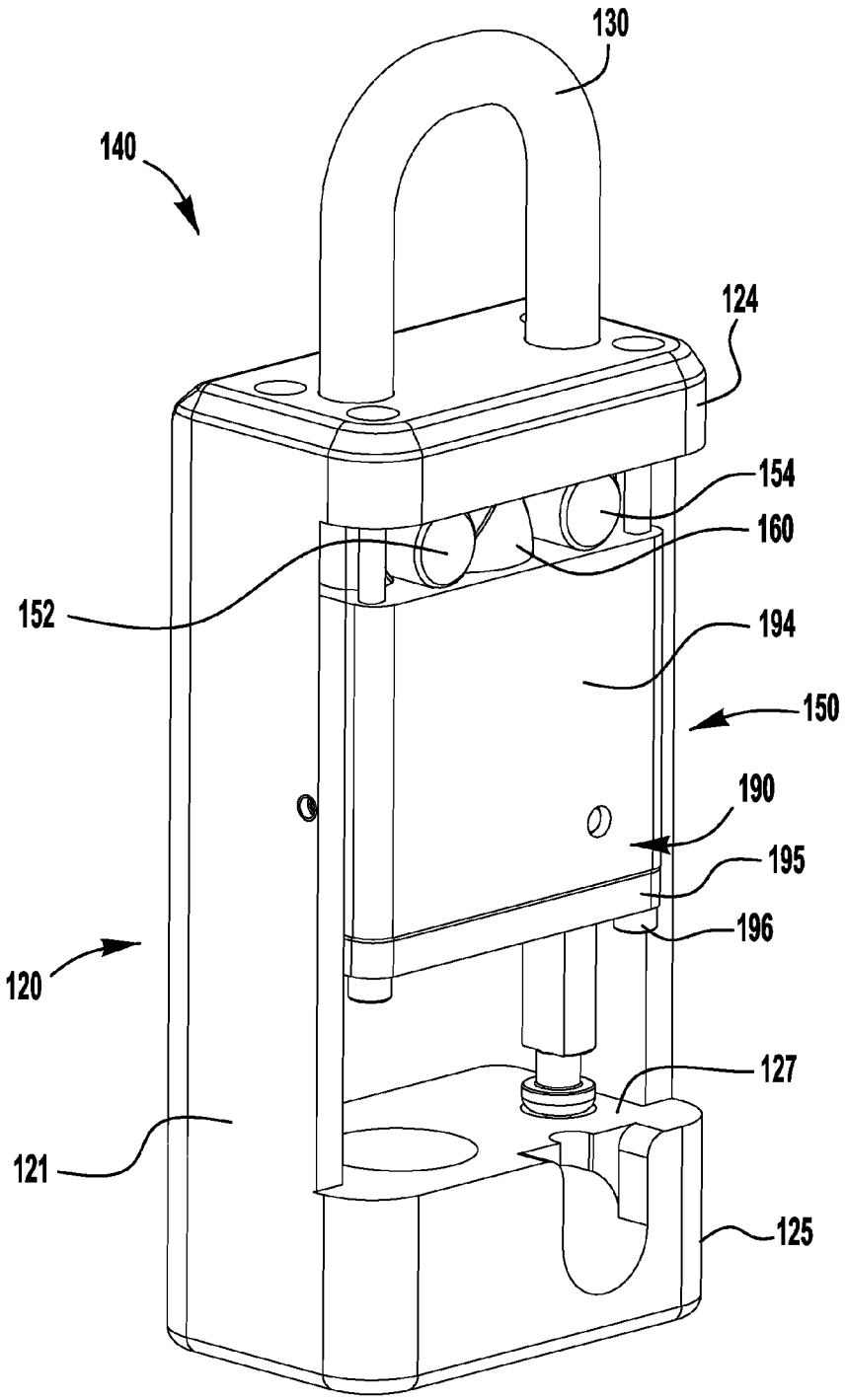
FIG. 6 is a front perspective view of the padlock of FIG. 4 shown in a locked condition, with the keypad panel, battery, and antenna removed to illustrate additional features of the padlock.
Figure 7:
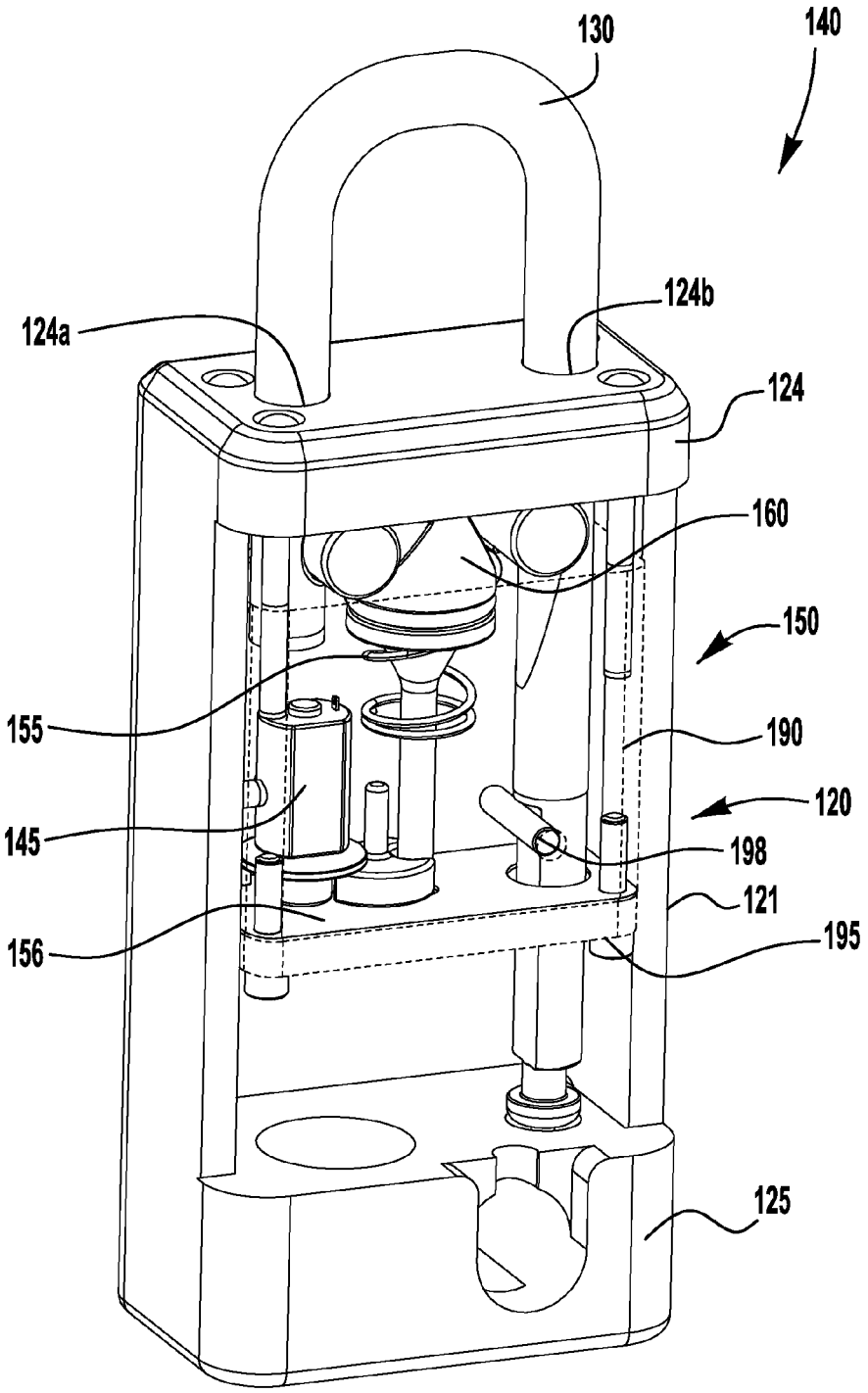
FIG. 7 is a front perspective view of the padlock of FIG. 4 shown in a locked condition, with the keypad panel, battery, and antenna removed and the lock subassembly housing shown in phantom to illustrate additional features of the padlock.
Figure 8:
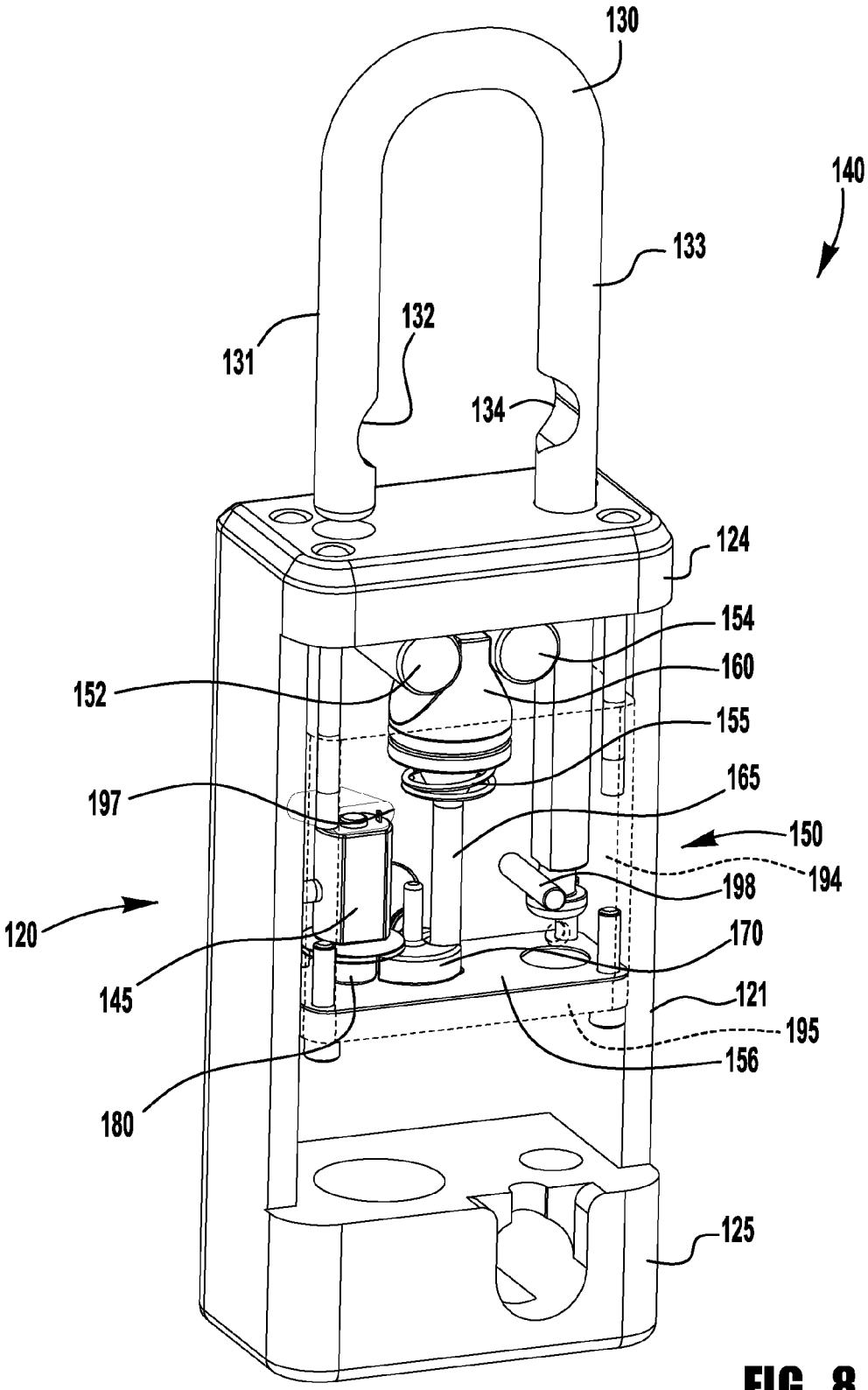
FIG. 8 is a front perspective view of the padlock of FIG. 4 shown in an unlocked condition, with the keypad panel, battery, and antenna removed and the lock subassembly housing shown in phantom to illustrate additional features of the padlock.

While any suitable electronic, electromechanical, or mechanical lock interface may be utilized, in the illustrated embodiment, the lock 140 includes a keypad assembly 143 disposed on a surface of the lock body 120 (FIG. 4). The keypad assembly 143 is in circuit communication with a PC board 144 (FIG. 5) including a microprocessor configured to evaluate access code combinations entered using the keypad, and to provide an actuating signal to the motor 145 if an entered access code corresponds to an authorized access code stored in a memory of the PC board 144. The motor 145 and PC board 144 may be powered by a battery 141 disposed within the lock body.

The exemplary motor 145 is secured within the module housing 190 by a set screw 193 threaded with the module housing and tightened against the motor 145. The exemplary module housing 190 includes a housing body 194 in which the upper and lower portions 191, 192 of the cavity and the shackle bores 194*a*, 194*b* are formed. The shackle bores 194*a*, 194*b* are isolated from the cavity 191, 192 to prevent contamination of the lower portion of the cavity from the shackle bores. A stop pin 198 is assembled with the exemplary module housing body 194 (e.g., press fit through openings in the housing body) to intersect the long leg shackle bore 194*b*, providing a stop for the long shackle leg 133 and preventing complete withdrawal or separation of the shackle 130 from the lock body 120. The blocker 160 is spring biased (e.g., by spring 155 compressed between the blocker 160 and a shoulder 191*a* in the upper cavity portion 191) towards an extended or shackle retaining or locked position.

Figure 9:
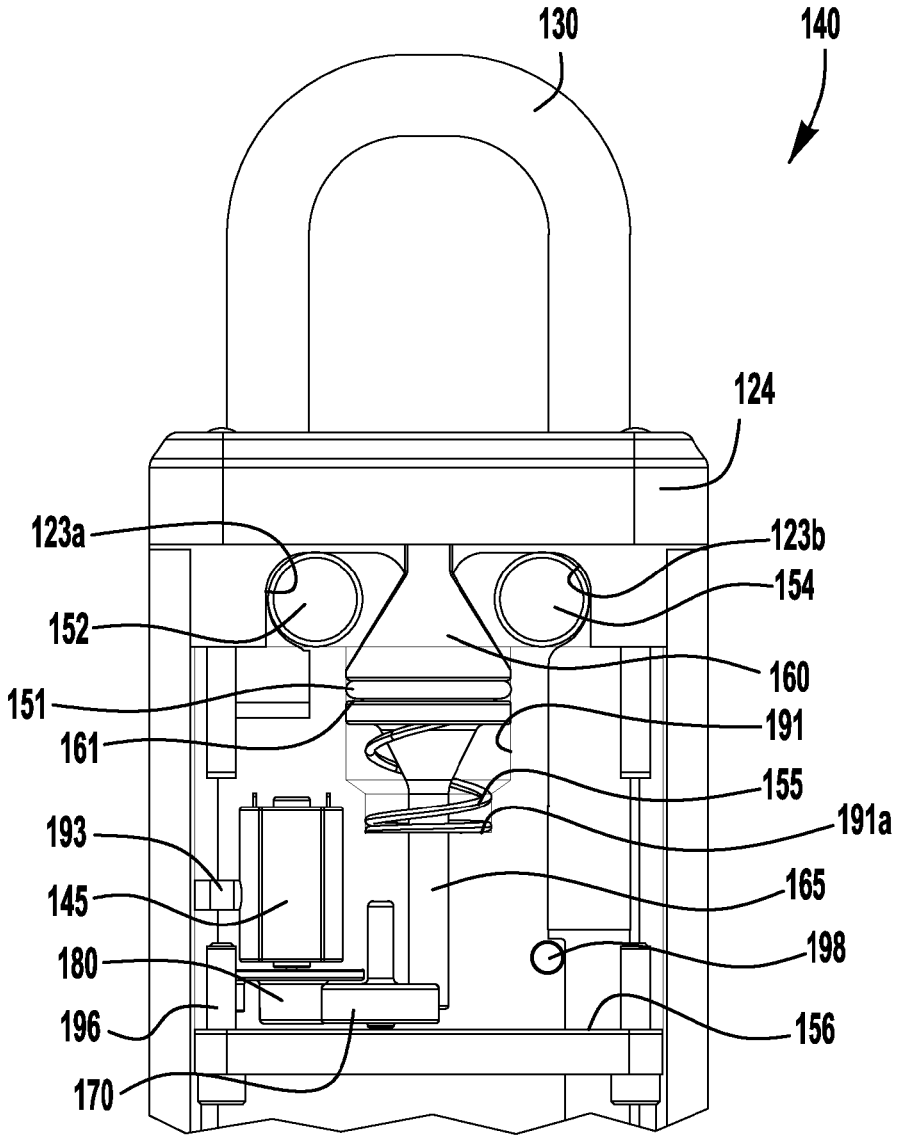
FIG. 9 is a partial front elevational view of the padlock of FIG. 4 shown in a locked condition, with the keypad panel, battery, and antenna removed and the lock subassembly housing shown in phantom to illustrate additional features of the padlock.
Figure 10:
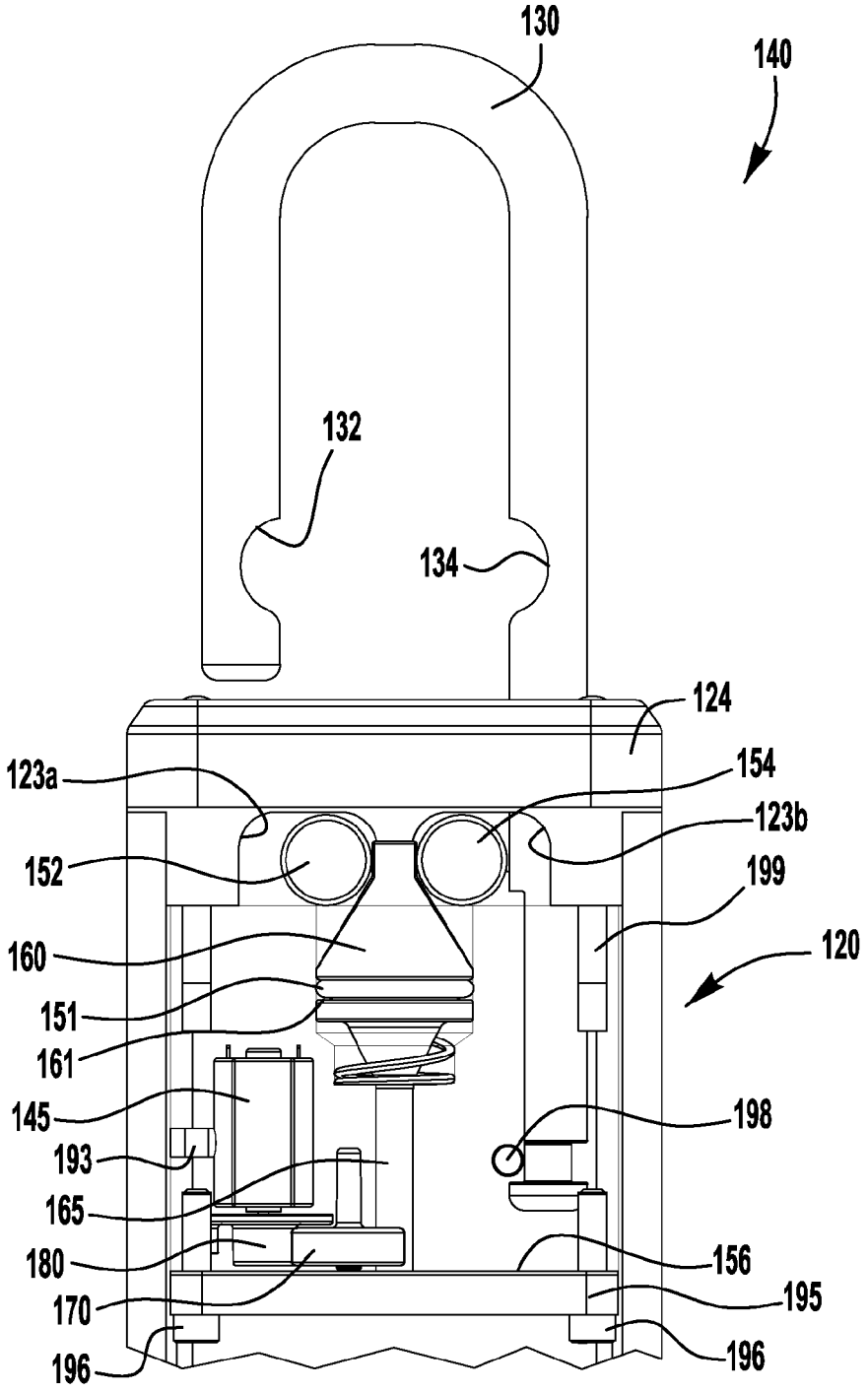
FIG. 10 is a partial front elevational view of the padlock of FIG. 4 shown in an unlocked condition, with the keypad panel, battery, and antenna removed and the lock subassembly housing shown in phantom to illustrate additional features of the padlock.
Figure 11:
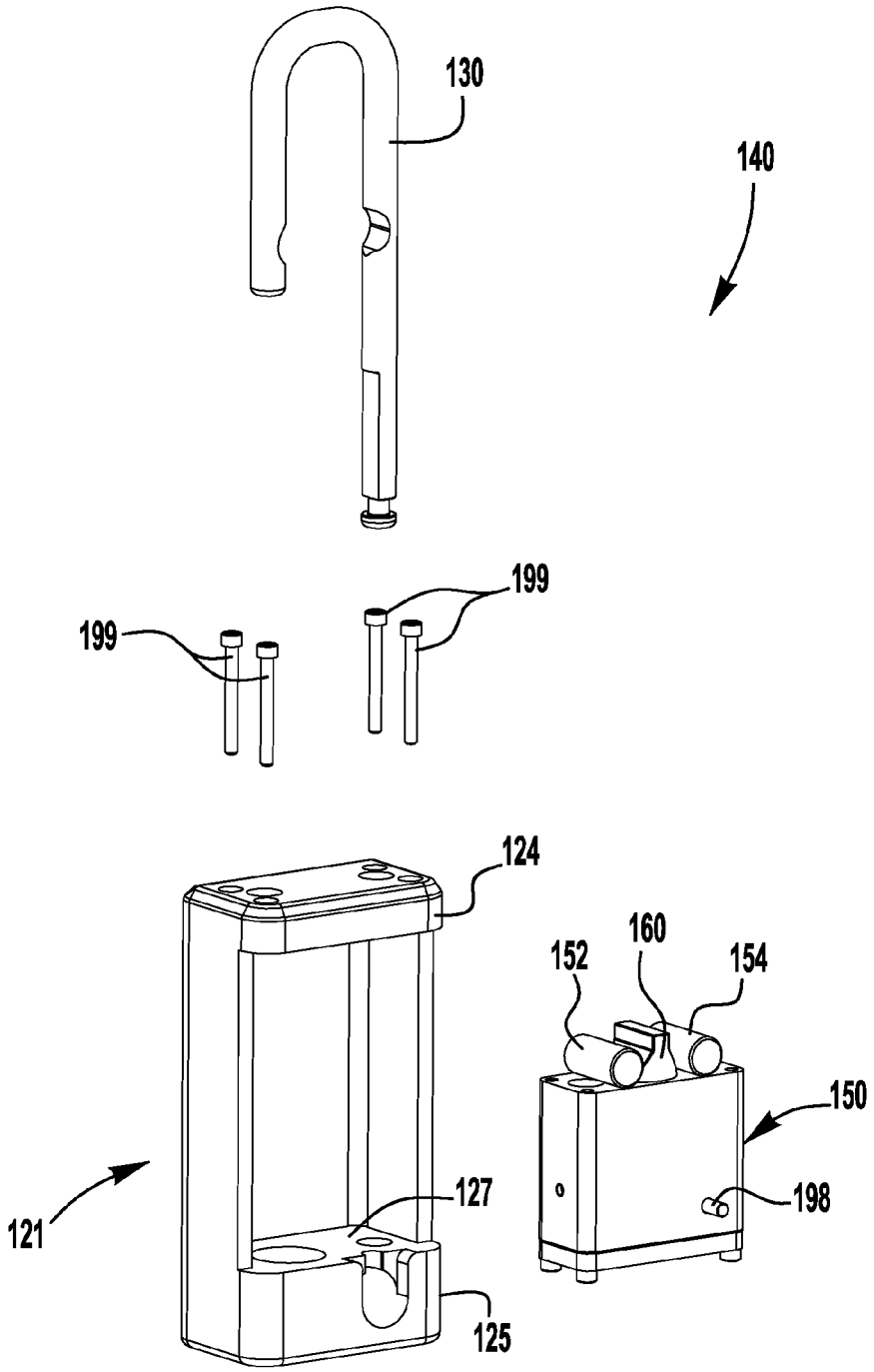
FIG. 11 is a partially exploded perspective view of the padlock of FIG. 4, with the keypad panel, battery, and antenna removed.
Figure 12:
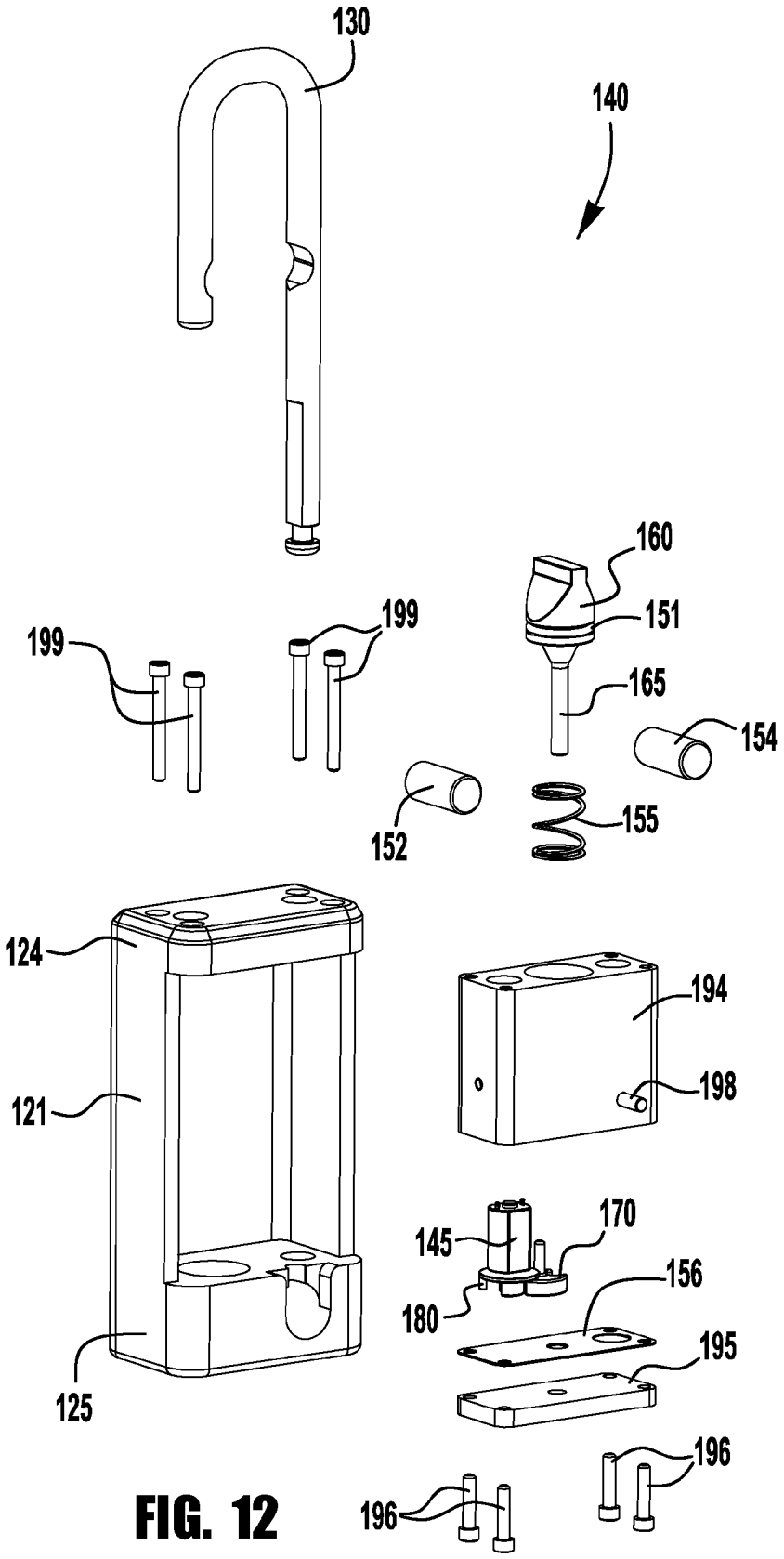
FIG. 12 is an exploded perspective view of the padlock of FIG. 4, with the keypad panel, battery, and antenna removed.

The module 150 is received between upper and lower body portions or walls 124, 125 of a lock body shell 121, through a side opening in the shell 121, and is secured to the upper body portion 124 of the shell by fasteners 199. The upper body portion 124 and module housing body 194 together define an upper cavity 123 into which the blocker 160 extends to force locking members 152, 154 retained in the upper cavity 123 into locking engagement with notches 132, 134 in the padlock shackle 130 extending through shackle openings 124*a*, 124*b* in the upper body portion 124. The exemplary locking members 152, 154 are cylindrical pins for which inward lateral movement is limited by the blocker 160 and outward lateral movement is limited by the shackle notches 132, 134 when the shackle 130 is closed and by contoured side walls 123*a*, 123*b* of the upper body portion 124 when the shackle is open (FIGS. 9 and 10). A cover plate 122 retaining the keypad assembly 143 (FIGS. 4 and 5) is secured to the side opening of the lock body shell 121 (e.g., by fasteners) to enclose the module 190 within the lock body 120.

The module housing body 194 is assembled to a bottom plate 195 by fasteners 196 to enclose the motor 145, latch cam 170, and driver cam 180 within the module housing 190. The bottom plate 195 and the lower body portion or lower wall 125 together define a recess 126 that retains the battery 141 and, optionally, an RFID antenna 142 electrically connected with the PC board 144, for example, for delivering wireless access codes to the lock 140, or for other wireless communication to or from the lock. The lower body portion 125 includes a partition wall 127 configured to receive and align the battery 141, RFID antenna 142 and long shackle leg 133.

One or more sealing components may be utilized, for example, to protect the motor 145 and other electronic and electromechanical internal components of the lock from exposure to moisture and other contaminants. In the exemplary embodiment, a gasket seal 156 is compressed between the housing body 194 and the bottom plate 195 to seal against ingress of contaminants between these components. A plug seal (not shown) may be installed in the side port 197 of the module housing 190 (FIGS. 5 and 8) to provide a seal around the electrical wiring (not shown). The blocker 160 includes a circumferential groove 161 that retains an annular seal 151 (e.g., a gasket or O-ring) sized to provide a sliding seal with the upper cavity portion 191. Other sealing materials may be provided for the PC board 144, battery 141, and antenna 142, such as, for example, a potting compound or additional gasket seals.

To assemble the exemplary padlock 100, the preassembled lock subassembly 150 is received between upper and lower body portions or walls 124, 125 of a lock body shell 121, through a side opening in the shell 121, with the shackle bores 194*a*, 194*b* aligning with the corresponding shackle openings 124*a*, 124*b* in the upper wall 124 of the lock body. The lock subassembly 150 is secured to the upper body portion 124 of the shell by fasteners 199. The short and long legs 131, 133 of the shackle 130 are installed through corresponding aligned shackle openings 124*a*, 124*b* and shackle bores 194*b*. The locking members 152, 154 are inserted vertically between the upper surface of the lock subassembly housing 190 and the upper wall portion 124 of the lock body, and laterally between the blocker 160 and the shackle legs 131, 133. A stop pin 198 is secured through the housing body 194 to secure the long shackle leg in the body 194. The motor 145 is electrically connected to the battery 142 retained by the lower wall portion 125 of the lock body, to the transmitter 141 retained by the lower wall portion 125 of the lock body, and to the keypad assembly 143 through PC board 144. The cover plate 122 retaining the keypad assembly 143 is secured to the side opening of the lock body shell 121 (e.g., by fasteners) to enclose the lock subassembly 190 within the lock body 120.

Figure 13:
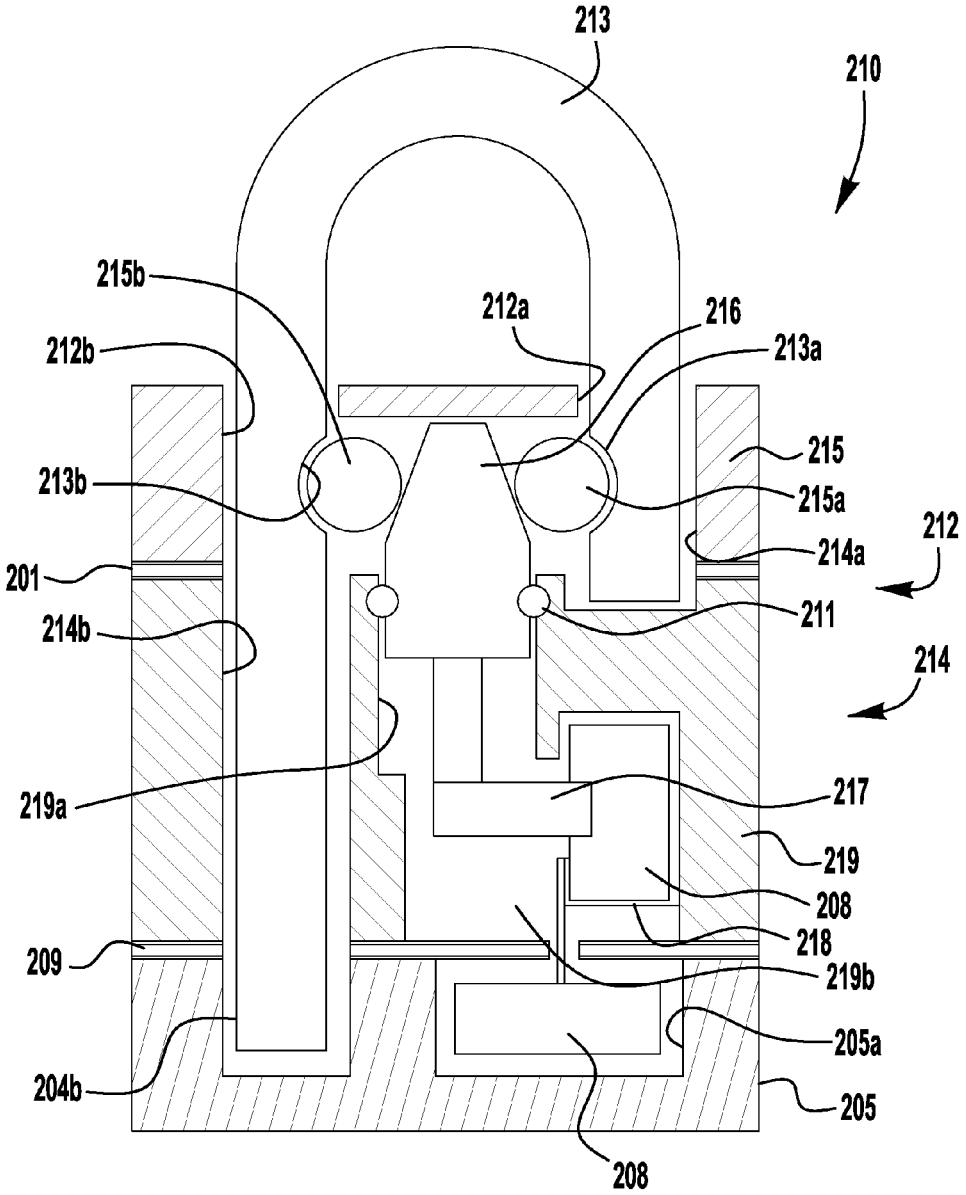
FIG. 13 is a front cross-sectional schematic view of another exemplary padlock shown in a locked condition.

In other embodiments, a modular lock subassembly may form part of the lock body, rather than being disposed within a lock body. In one such exemplary embodiment, as schematically shown in FIG. 13, a padlock 210 includes a lock subassembly module 214 that forms a portion of a lock body 212 and includes a blocker 216 disposed within and extending from a blocker bore or upper cavity portion 219*a* in a module housing 219. The module includes shackle bores 214*a*, 214*b* receiving the shackle legs. The module 214 is assembled with an upper body portion 215 (e.g., by fasteners, not shown) into which the blocker 216 extends to force locking members 215*a*, 215*b* retained in the upper body portion 215 into locking engagement with notches 213*a*, 213*b* in the padlock shackle 213 extending through shackle openings 212*a*, 212*b* in the upper body portion 215. In the locked condition, shown in FIG. 4, a latch member 217 within an internal cavity 219*b* of the module housing 219 secures the blocker 216 in a shackle retaining position that prevents disengagement of the locking members 215*a*, 215*b* from the shackle notches 213*a*, 213*b*. In the unlocked, closed shackle condition, the latch member 217 is moved or is made movable by a driver 218 within the module housing cavity 219*b* to permit movement of the blocker 216 to a shackle releasing position and disengagement of the locking members 215*a*, 215*b* from the shackle notches 213*a*, 213*b* for withdrawal of the shackle 213 from the lock body 212.

Additionally, the exemplary padlock 210 includes a lower body portion 205 assembled with the module 214 (e.g., by fasteners, not shown). The lower body portion 205 includes a shackle bore 204*b* that receives the long shackle leg when the shackle is in the closed position. The exemplary lower body portion further includes an internal cavity 205*a* that retains additional lock components (e.g., battery, microprocessor, signal transceiver), which may be electrically or mechanically connected with the driver 218, as shown schematically at 208.

As shown, a seal 211 may be provided between the sliding blocker 216 and an inner surface of the blocker bore 219*a*, such that moisture or other contaminants that enter the upper body portion 215 of the lock body 212 through shackle openings 212*a*, 212*b* in the upper body portion 215 are prevented from entering the module housing cavity 219*b*. Further, shackle bores 214*a*, 214*b* in the module housing 219 may be isolated from the blocker bore or upper cavity portion 219*a* and lower cavity portion 219*b* to prevent contamination of the lower portion of the cavity 219*b* and the lock components disposed therein. Gasket seals 201, 209 or other sealing components may be provided between the module 214 and the upper and lower body portions 215, 205, respectively.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

I claim:

1. A lock subassembly for assembly within a lock body of a padlock, the lock subassembly comprising:

a housing defining an internal cavity and at least one shackle bore isolated from the internal cavity, such that contaminants entering the at least one shackle bore are prevented from entering the internal cavity;

a locking element disposed in a first portion of the internal cavity and extending above an uppermost surface of the housing, the locking element being movable between a locked position for interlocking engagement with a shackle and an unlocked position for releasing the shackle; and a locking mechanism disposed in a second portion of the internal cavity and operable between a locking condition securing the locking element in the locked position and an unlocking condition permitting movement of the locking element to the unlocked position.

2. The lock subassembly of claim 1, wherein the locking mechanism comprises an electromechanical locking mechanism.

3. The lock subassembly of claim 1, further comprising an annular seal member disposed between the locking element and an internal surface of the first portion of the lock cavity.

4. The lock subassembly of claim 1, wherein the locking element comprises a blocker slideable in a vertical direction between the locked position and the unlocked position.

5. The lock subassembly of claim 4, wherein the blocker is spring biased toward the locked position.

6. The lock subassembly of claim 4, wherein the locking mechanism comprises a latch member, wherein when the locking mechanism is in the locking condition, a portion of the latch member aligns with an adjacent portion of the blocker to block movement of the blocker from the locked position to the unlocked position, and when the locking mechanism is in the unlocking condition, the portion of the latch member is misaligned with the adjacent portion of the blocker to permit movement of the blocker from the locked position to the unlocked position.

7. The lock subassembly of claim 6, wherein the locking mechanism further comprises a motor operable to move the latch member from the locking condition to the unlocking condition.

8. The lock subassembly of claim 1, wherein the at least one shackle bore includes first and second shackle bores isolated from the lock cavity.

9. The lock subassembly of claim 1, wherein the housing includes a housing body defining the internal cavity and an end plate assembled to the housing body and enclosing the second portion of the internal cavity.

10. A padlock comprising:

a lock body;

a shackle having long and short legs receivable in corresponding first and second shackle openings in the lock body, the shackle being moveable in an axial direction between a refracted position and an extended position, the short leg being withdrawn from the lock body in the extended position;

a locking member disposed in the lock body and engageable with the shackle to secure the shackle in the retracted position; and a lock subassembly disposed within the lock body, the lock subassembly comprising:

a housing defining an internal cavity;

a blocker disposed in a first portion of the internal cavity and extending beyond an upper surface of the housing, the blocker being movable between a locked position securing the locking member in interlocking engagement with the shackle and an unlocked position permitting disengagement of the locking member from the shackle; and a locking mechanism disposed in a second portion of the internal cavity and operable between a locking condition securing the blocker in the locked position and an unlocking condition permitting movement of the blocker to the unlocked position.

11. The padlock of claim 10, wherein one of the long shackle leg and the short shackle leg extends into a shackle bore in the lock subassembly housing, the shackle bore being isolated from the internal cavity to preventingress of contaminants into the internal cavity from the shackle bore.

12. The padlock of claim 10, wherein the long shackle leg and the short shackle leg extend into corresponding first and second shackle bores in the lock subassembly housing, the first and second shackle bores being isolated from the internal cavity to prevent ingress of contaminants entering the lock subassembly housing through the shackle bore.

13. The padlock of claim 10, wherein the blocker is slideable in a vertical direction between the locked position and the unlocked position.

14. The padlock of claim 13, wherein the blocker is spring biased toward the locked position, wherein when the locking mechanism is in the unlocked condition and the shackle is pulled in the vertical direction, the shackle forces the locking member against a tapered camming surface of the blocker to move the blocker to the unlocked position.

15. A method of assembling a padlock, the method comprising:

providing a lock body including an upper wall defining first and second shackle openings, a lower wall, and a side wall extending between the upper wall and the lower wall and defining a side opening in the lock body;

providing a lock subassembly disposed within the lock body, the lock subassembly comprising a housing defining an internal cavity and a shackle bore isolated from the internal cavity, a blocker extending from the internal cavity beyond an upper surface of the housing, and a locking mechanism disposed in the internal cavity;

inserting the lock subassembly into the lock body through the side opening, such that the shackle bore aligns with the first shackle opening;

installing a shackle leg of a shackle through the first shackle opening and through the shackle bore; and inserting a locking member vertically between the upper surface of the lock subassembly housing and the upper wall of the lock body, and laterally between the blocker and the shackle.

16. The method of claim 15, further comprising securing the lock subassembly to the upper wall of the lock body.

17. The method of claim 15, further comprising electrically connecting the locking mechanism to a battery retained by the lock body external to the lock subassembly.

18. The method of claim 15, further comprising electrically connecting the locking mechanism to a transmitter retained by the lock body external to the lock subassembly.

19. The method of claim 15, further comprising electrically connecting the locking mechanism to an electronic lock interface and assembling the electronic lock interface to the side opening of the lock body.

20. The method of claim 15, further comprising securing the shackle leg within the shackle bore to prevent separation of the shackle from the lock subassembly.

21. The padlock of claim 10, wherein the internal cavity is sealed against ingress of contaminants entering the lock body through the first and second shackle openings.

* * * * *